US006402286B1

(12) United States Patent
Hu et al.

(10) Patent No.: US 6,402,286 B1
(45) Date of Patent: Jun. 11, 2002

(54) FUNCTION TEST DEVICE FOR OPTICAL PRINT HEAD HEATERS IN THERMAL BUBBLE PRINTERS

(75) Inventors: Hung-Lieh Hu; Yuan-Liang Lan; Chieh-Wen Wang; Jhih-Ping Lu; Charles C. Chang, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/824,791

(22) Filed: Apr. 4, 2001

(30) Foreign Application Priority Data

Feb. 9, 2001 (TW) ..... 90102841

(51) Int. Cl.[7] ..... B41J 29/393

(52) U.S. Cl. ..... 347/19

(58) Field of Search ..... 347/19, 11, 12, 347/62, 59, 14

(56) References Cited

U.S. PATENT DOCUMENTS 4,369,455 A * 1/1983 McConica et al. ..... 347/19
4,996,487 A 2/1991 McSparran et al. ..... 347/19

OTHER PUBLICATIONS

Deboo, Gordon J., Integrated Circuit and Semiconductor device 1977, McGraw Hill, 2nd edition, pp. 354–356.*

* cited by examiner

*Primary Examiner*—John Barlow
*Assistant Examiner*—Charles W. Stewart, Jr.
(74) *Attorney, Agent, or Firm*—Birch, Stewart, Kolasch & Birch, LLP

(57) ABSTRACT

A function test device for optical print head heaters in thermal bubble printers, which includes: a test end power supply to provide the power needed for the test device; a linear optical coupling device serially connected between a pulse power supply for driving a print head circuit and the print head heater to detect variation of a triggering current; and an amplification circuit to amplify an output signal of the linear optical coupling device and send the signal to a microprocessor.

7 Claims, 2 Drawing Sheets

FUNCTION TEST DEVICE FOR OPTICAL PRINT HEAD HEATERS IN THERMAL BUBBLE PRINTERS

BACKGROUND OF THE INVENTION

1. Field of Invention

The present invention relates to a function test device for print head heaters and, in particular, to a function test device for optical print head heaters used in thermal bubble printers.

2. Related Art

The inkjet technology has been widely applied to printers, facsimile machines, and other computer peripheral devices. For thermal bubble inkjet printers, the key element is the thermal bubble inkjet print head.

An inkjet print head is composed of several nozzles, each of which is associated with a heater. When the heater receives an energy pulse, a droplet of ink is pushed out of the print head through the corresponding nozzle. To increase the reliability of printing quality, some basic tests have to be performed on the printer to make sure each energy pulse during a print job is indeed imposed on the heater.

There are many reasons why impulse signals cannot be successfully sent to the heater. Such examples are damaged heaters, broken soft circuit boards, bad contacts between a printer probe and the soft circuit board, and improper installation of the print head. In these cases, a good printer should be able to detect the error. The U.S. Pat. No. 4,996,487 disclosed such a mechanism and method for detecting errors of the heater in an inkjet printer. However, the cited reference can only detect whether the heater is out of order, but cannot test functions of the heater and the isolation property between a test circuit and a printing circuit.

Therefore, it becomes a hot topic to provide a test mechanism and method for testing the functions of an optical heater in a thermal bubble inkjet print head and for forming isolation between a test circuit and a print driving circuit.

SUMMARY OF THE INVENTION

An objective of the invention is to provide a device for testing the functions of an optical print head heater in a thermal bubble printer. The device is not only able to detect whether the print head heater is out of order, but can also test the function of the heater. It also provides the isolation between a test circuit and a print circuit.

The disclosed test device contains at least a test end power supply to provide the power needed for the test device; a linear optical coupling device serially connected between a pulse power supply for driving a print head circuit and the print head heater to detect variation of a triggering current; and an amplification circuit to amplify an output signal of the linear optical coupling device and send the signal to a microprocessor.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
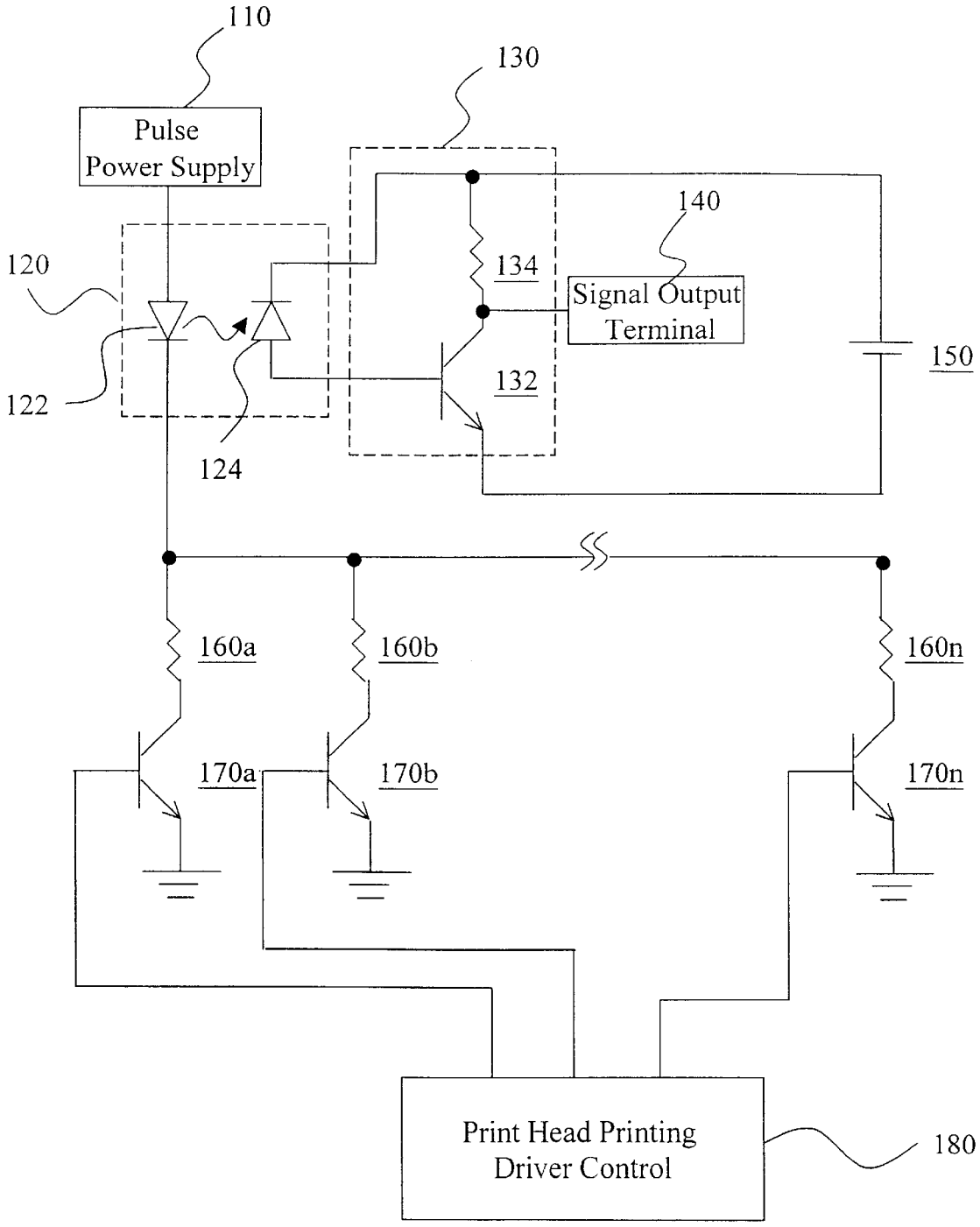
FIG. 1 shows a current detection circuit in the print head heater of the invention.

This specification discloses a function test device for optical print head heaters in thermal bubble printers. As shown in FIG. 1, the device contains at least a pulse power supply 110 for driving a print head resistor, a linear optical coupling device 120, an amplification circuit 130, a test end power supply 150, several print head heater resistors 160*a*~160*n*, several transistors 170*a*~170*n* for driving the print head heater resistors, and a print head printing driver control 180.

The print head heater can be one in an inkjet printer, a graphics drawer, or a facsimile machine. In either case, the print head heater is connected to a specific nozzle via the link of the print head heater resistors 160*a*~160*n*. Each of the print head heater resistors 160*a*~160*n* are grounded through the transistors 170*a*~170*n*. The base of each of the transistors 170*a*~170*n* further connects to a print head printing control 180, through which different transistors 170*a*~170*n* are selectively driven so that the current provided by the pulse power supply 110 can run through the print head heater resistors 160*a*~160*n* under control. Therefore, ink can be accurately jetted out of the inkjet printer, the graphic drawer, or the facsimile machine.

The disclosed test device contains a linear optical coupling device 120 serially connected between the pulse power supply 110, which drives a print head circuit, and the print head heater resistors 160*a*~160*n* to detect variation of a triggering current. The linear optical coupling device 120 is composed of a light-emitting diode (LED) 122 and a light-absorbing diode 124.

Since the heater of an inkjet print head requires driving pulses with stable voltages during the work, it is thus important to measure the current in order to know the functioning condition of the heater. For two 30Ω resistors with the powers 1W and ⅛W, respectively, a fixed voltage pulse supply can result in different currents due to different powers. The invention uses the linear optical coupling device 120 (containing the LED 122 and the light-absorbing diode 124) to detect the variation of a triggering current. The output signals from the linear optical coupling device 120 are amplified by an amplification circuit 130. The anode of the light-absorbing diode 124 connects to the base of a signal amplification transistor 132. The collector of the signal amplification transistor 132 further connects to a collector resistor 134. The signal can be output through a signal output terminal 140 to indicate whether any current runs through the heater and the functioning condition of the print head resistor.

The invention also provides a test end power supply 150 to provide the power needed for the test device. It also provides the isolation function between the power supply and the signals in a heater driving circuit and a test circuit.

Figure 2:
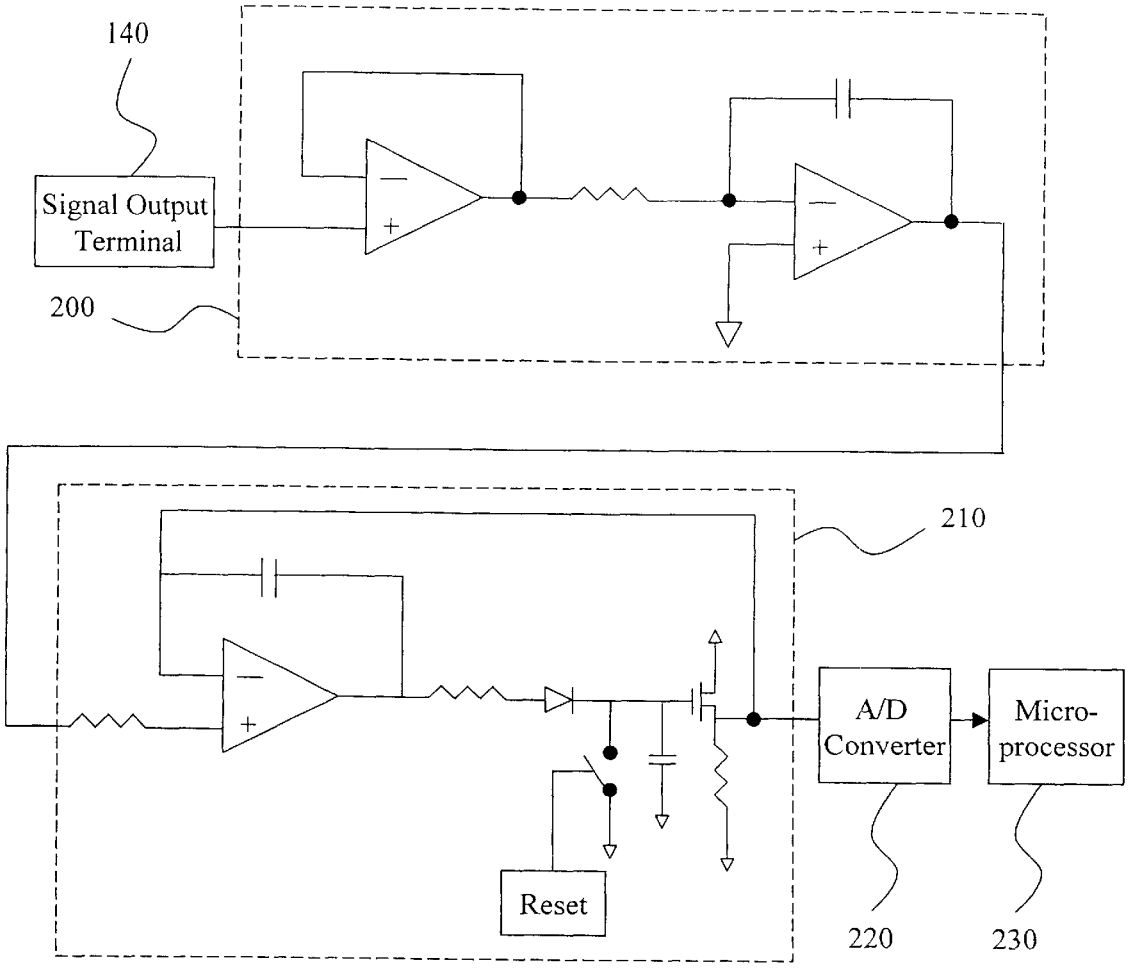
FIG. 2 is a schematic view of the integration circuit and the peak detection circuit after signal output according to the invention.

With reference to FIG. 2, the signal output from the signal output terminal 140 in FIG. 1 passes through an integration circuit 200 and a peak detection circuit 210. The detected signal is further converted by an analog/digital (A/D) converter 220 and output to a microprocessor 230 to process. This can detect whether any current flows through the heater and the functioning conditions of the print heat heater resistors. Since the test circuit disclosed herein is simple, the load effect in detection is smaller than resistor-type and transformer-type circuits.

Advantages of the Invention

1. It can simultaneously detect whether and current flows through the heater and the conditions of the resistors.

2. It can provide the isolation between the power supply and signals in the heater driver end circuit and the test end circuit.

3. It has a lower load than resistor-type and transformer-type circuits.

4. It circuit is simple and has a lower manufacturing cost.

The invention being thus described, it will be obvious that the same may be varied in many ways. Such variation are not to be regarded as a departure from the spirit and scope of the invention, and all such modifications as would be obvious to one skilled in the art are intended to be included within the scope of the following claims.

What is claimed is:

1. A test device for optical print head heaters in thermal bubble printers, which comprises:

a test end power supply to provide the power needed for the test device;

a linear optical coupling device serially connected between a pulse power supply for driving a print head circuit and the print head heater to detect variation of a triggering current;

an amplification circuit to amplify an output signal of the linear optical coupling device;

an integration circuit to integrate the output signal of the amplification circuit;

a peak detection circuit to detect the peak value of the output signal of the integration circuit; and an analog/digital converted to digitize the output signal of the peak detection circuit and send to the microprocessor.

2. The test device of claim 1, wherein the print head heater is used in any device selected from the group comprising inkjet printers, graphics drawers, and facsimile machines.

3. The test device of claim 1, wherein the print head heater comprises a plurality of print head heater resistors, a plurality of transistors for driving the plurality of print head heater resistors, and a print head printing driver control.

4. The test device of claim 1, wherein the test end power supply has the function of isolating the power supply and signals in the heater driver circuit from the test end circuit.

5. The test device of claim 1, wherein the linear optical coupling device further comprises a light-emitting diode and a light-absorbing diode.

6. The test device of claim 1, wherein the amplification circuit further comprises a signal amplification transistor and a collector resistor.

7. The test device of claim 1 wherein the integration circuit, the peak detection circuit and the analog/digital converted detect, convert, and send output signals to the microprocessor.

* * * * *